US006113472A

United States Patent [19]

Rosa

[11] Patent Number: 6,113,472

[45] Date of Patent: Sep. 5, 2000

[54] METHOD AND AN APPARATUS FOR POLISHING A ROLLER AND FOR REMOVING THE CHROMIUM PLATING THEREOF

[76] Inventor: Valerio Rosa, via Roma 13/b, 36030 Zugliano (VI), Italy

[21] Appl. No.: 09/373,733

[22] Filed: Aug. 13, 1999

Related U.S. Application Data

[63] Continuation-in-part of application No. 08/911,000, Aug. 14, 1997, abandoned.

[30] Foreign Application Priority Data

Feb. 28, 1997 [IT] Italy ..... VI97A0036

[51] Int. Cl.[7] ..... B24B 49/00

[52] U.S. Cl. ..... 451/49; 451/51; 451/63; 451/58; 451/160; 451/285; 451/11

[58] Field of Search ..... 451/9, 10, 11, 451/49, 51, 54, 58, 63, 158, 160, 285, 283, 397, 398; 82/1.11, 148

[56] References Cited

U.S. PATENT DOCUMENTS

| | | | |
|---|---|---|---|
| 3,881,887 | 5/1975 | Mcmaster | 451/49 |
| 4,716,687 | 1/1988 | Tsukamoto et al. | 451/49 |
| 5,447,463 | 9/1995 | Schmitz | 451/49 |
| 5,525,092 | 6/1996 | Hirano et al. | 451/49 |

*Primary Examiner*—Eileen P. Morgan
*Attorney, Agent, or Firm*—Daniel O'Byrne

[57] ABSTRACT

A method and to an apparatus for polishing a gravure roller, and for removing the chromium plating thereof, wherein the roller has a metallic shell galvanically covered by a copper layer having a pattern and a protective chromium plating. The method includes the steps of hitting the chromium plating with blunt bodies associated with a first rotating disk, thereby removing the chromium plating, which is broken and removed through the elastic collapsing of the underlying copper layer when the blunt bodies hit the chromium plating; and smoothing the copper layer by means of a second rotating disk provided with abrasive members. The apparatus includes an ammeter circuit for controlling the pressure exerted by the disk on the roller surface.

3 Claims, 12 Drawing Sheets

METHOD AND AN APPARATUS FOR POLISHING A ROLLER AND FOR REMOVING THE CHROMIUM PLATING THEREOF

The present application is a continuation-in-part of application Ser. No. 08/911,000, filed on Aug. 14, 1997, now abandoned.

BACKGROUND OF THE INVENTION

1. Field of the Invention

The present invention relates to a method and to an apparatus for polishing a roller, particularly a gravure roller, and for removing the chromium plating thereof.

2. Description of the Prior Art

A gravure roller is generally made of a steel cylinder covered with a copper layer on which a pattern or drawing can be impressed. A chromium protective covering is subsequently applied to the copper layer. The gravure roller is then ready to be used for reproducing the pattern or drawing on a sheet of paper.

When the printing operation is completed, the pattern or drawing has to be eliminated from the gravure roller. As well known in the art, such operation is very difficult and time consuming. The operation of eliminating the pattern from the gravure roller consists of a first step of removing the chromium plating by electrical treatment and a second step of working the copper layer with special machines in order to remove the pattern from it.

This prior art method has the disadvantage of requiring the use of very expensive machines and of requiring long working cycles because of the set up time necessary to move the cylinders from the galvanic chromium plating removal apparatus to the machine tools for removing the pattern from the copper layer.

On the other hand, instead of the removing the protective chromium plating by a galvanic treatment, other systems are known which use lathe—smoothing machines which turn the cylinder and at the same time remove the chromium plating and the pattern on the copper layer. After the removal of the pattern the copper layer has to be smoothed. Such method, which is indeed rarely used, requires cheaper equipment than the above described method but also requires longer working times.

SUMMARY OF THE INVENTION

The present invention aims at overcoming the above mentioned disadvantages of the prior art.

An object of the present invention is to provide an apparatus adapted to remove the chromium plating and the pattern from the copper layer, with a single operation.

A further object of the invention is to provide an apparatus adapted to smooth and polish the copper layer underlying the chromium plating.

A further object of the invention is to provide an apparatus adapted to provide a perfectly cylindrical surface.

A further object of the invention is to provide an apparatus adapted to break and to remove the chromium surface from the cylinders without causing stress and damage to the copper layer.

Still a further object of the invention is to provide an apparatus adapted to perform the working in a shorter time and with lower cost with respect to the prior art methods.

The above aim and objects, are achieved by an apparatus as claimed in the appended claims.

According to a preferred embodiment, the blunt bodies are diamond granules inserted on a disk surface fixed to a working operative head which makes the disk turn.

While the disk turns, each diamond granule forces the chromium covering against the underlying copper layer that elastically collapses and causes the more rigid chromium to break. In this manner, the chromium is shattered into many pieces and can be easily torn from the underlying copper layer to which it is electrically bonded.

Preferably, in order to remove the chromium plating, two disks are used: the first disk mainly performs the chromium breaking while the second disk also removes the pattern.

After the chromium plating and the pattern are removed, the underlying copper layer is smoothed by the second rotating disk provided with abrasive elements.

According to a preferred embodiment, the supporting and rotating assembly of the roller to be worked, comprises a pair of opposed tailstocks that support the roller to be worked and a motor assembly fastened to one end of the cylinder and adapted to rotate the cylinder about an horizontal axis. The tailstocks and motor assembly are supported by the apparatus baseframe.

The siding means, adapted to shift said operative heads, comprises sliders which cooperate with the handling means consisting of cables connected to the sliding means and wound on drums and transmission pulleys.

The operative heads are connected to the frame by kinematic means comprising closed jack chains which engage with sprocket wheels supported by a central structure which is supported on the same frame. At least one of said sprocket wheels, which engage with each chain, is connected with an engine which makes it turn on clockwise or counterclockwise direction according to the operative needs.

The oscillation assembly, with which each operative heads is equipped, is a mechanic-pneumatic assembly operated by an engine, the rotation of which is controlled by an electronic system with ammeter control, suited to change the position of the rotating disk and suited to maintain a constant pressure during the machining.

BRIEF DESCRIPTION OF THE DRAWINGS

The above and other aims and objects will be better understood in the following detailed description of a preferred embodiment of the apparatus according to the invention, with reference to the enclosed drawings wherein.

DESCRIPTION OF THE PREFERRED EMBODIMENTS

Figure 1:
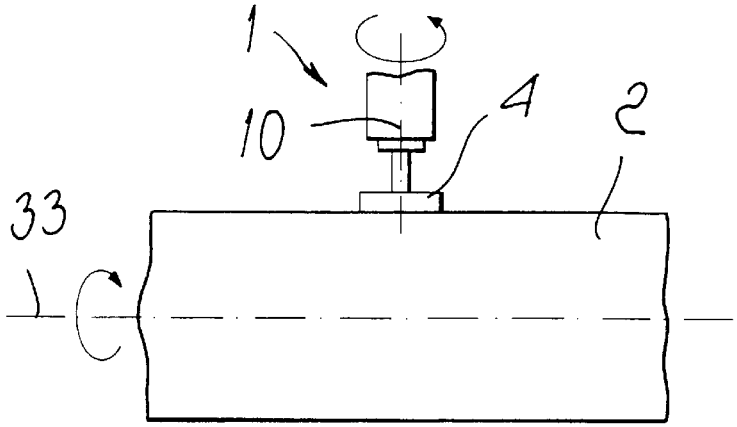
FIG. 1 is a schematic view of a gravure roller applied to the apparatus according to the invention.

With reference to the figures, the apparatus for polishing a roller and for removing the chromium plating thereof, according to the invention, generally designated by the reference numeral 200, is adapted to work the surface of a gravure roller 2 which is made to turn around its longitudinal axis 3 by a rotating means.

A first disk 4 is applied to the operating head 1, and is adapted to turn about the longitudinal axis 10 of the operating head. First disk 4 is provided with a plurality of blunt bodies 41 constituted, as in the present embodiment, for example, by diamond granules associated with the disk 4.

Alternatively, the blunt bodies 41 may be constituted for example by artificial granules, such as boron carbide or similar materials, having a lower hardness than that of the diamond but still very close to it.

Figure 2:
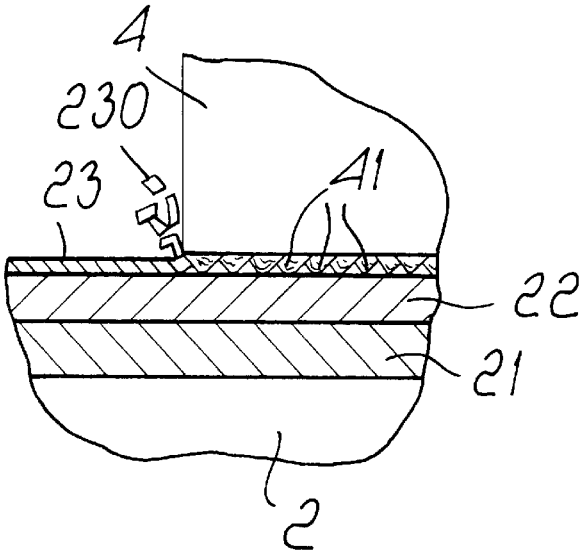
FIG. 2 is an enlarged section view showing the breaking and removing step of the chromium covering.

As better shown in detail in FIG. 2, roller 2 is made of a shell 21, preferably of steel, on which a copper layer 22 is galvanically deposited and then covered by a protective chromium plating 23.

During the rotation of the roller 2 and the disk 4, each of them around their own longitudinal axis 33 and 10 respectively, the blunt bodies 41 impinge on the protective chromium plating 23 and break it because of the elastic collapsing of the underlying copper layer 22. The collapsing of the copper layer 22 under the hard chromium plating allow the diamond granules 41 to break the chromium, crumbling it in very small pieces 230 and without abrading the chromium plating, but detaching it from the copper layer and moving it away. During the operation of crumbling and moving away the chromium, the pattern on the copper layer is eliminated too. In some cases the use of another rotating disk may be necessary to obtain the complete removal of the pattern and of the possible chromium residuals. After the chromium and copper pattern are removed, the copper surface itself, designated by the numeral 222 in FIG. 3, appears lightly wrinkled and is smoothed by the use of further rotating disks supported on respective operating heads.

The apparatus according to the invention also comprises a baseframe 202 having a support and rotating assembly 3 for the roller 2 and a smoothing assembly, globally designated by the reference numeral 5, for the surface 41 of the roller 2.

The rotating assembly 3 comprises tailstocks 40 which support the two ends of the roller 2 which is turned by a motor 42. The surface 441 of roller 2 is kept wet by a parallel wetting roller which draws refrigerating liquid from a tank 32 provided on the baseframe 202.

Figure 3:
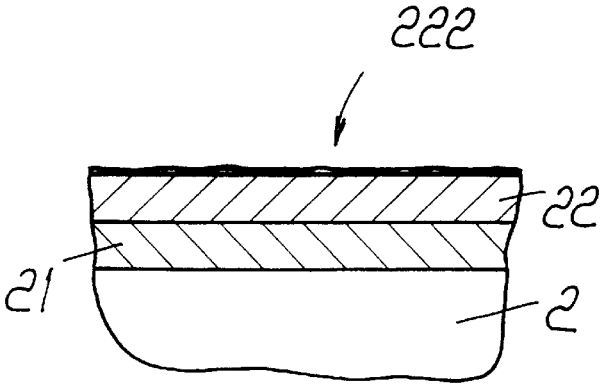
FIG. 3 is an enlarged section view showing the surface of the gravure roller after the chromium removing and before undergoing the smoothing step.

The side surface 441 of roller 2 is smoothed by the smoothing assembly, globally designated by the numeral 5, formed by a plurality of operating heads 1, as better shown in FIG. 3.

The operating heads 1 are connected to kinematic members belonging to a central structure 50 supported by a frame 51 which is supported by supporting members constituted by a vertical rod 35 located at the ends thereof and fixed to the baseframe 202.

As shown in FIG. 3, the kinematic members comprise sprocket wheels 52 that are mutually spaced apart and located on two, substantially horizontal and parallel plates where a chain 53 is placed in connection of each plate on which each sprocket wheel 52 lie. The chain 53 connects the sprocket wheels 52 and at least one of the sprocket wheel is connected with drive means adapted to drive the chain.

Figure 16:
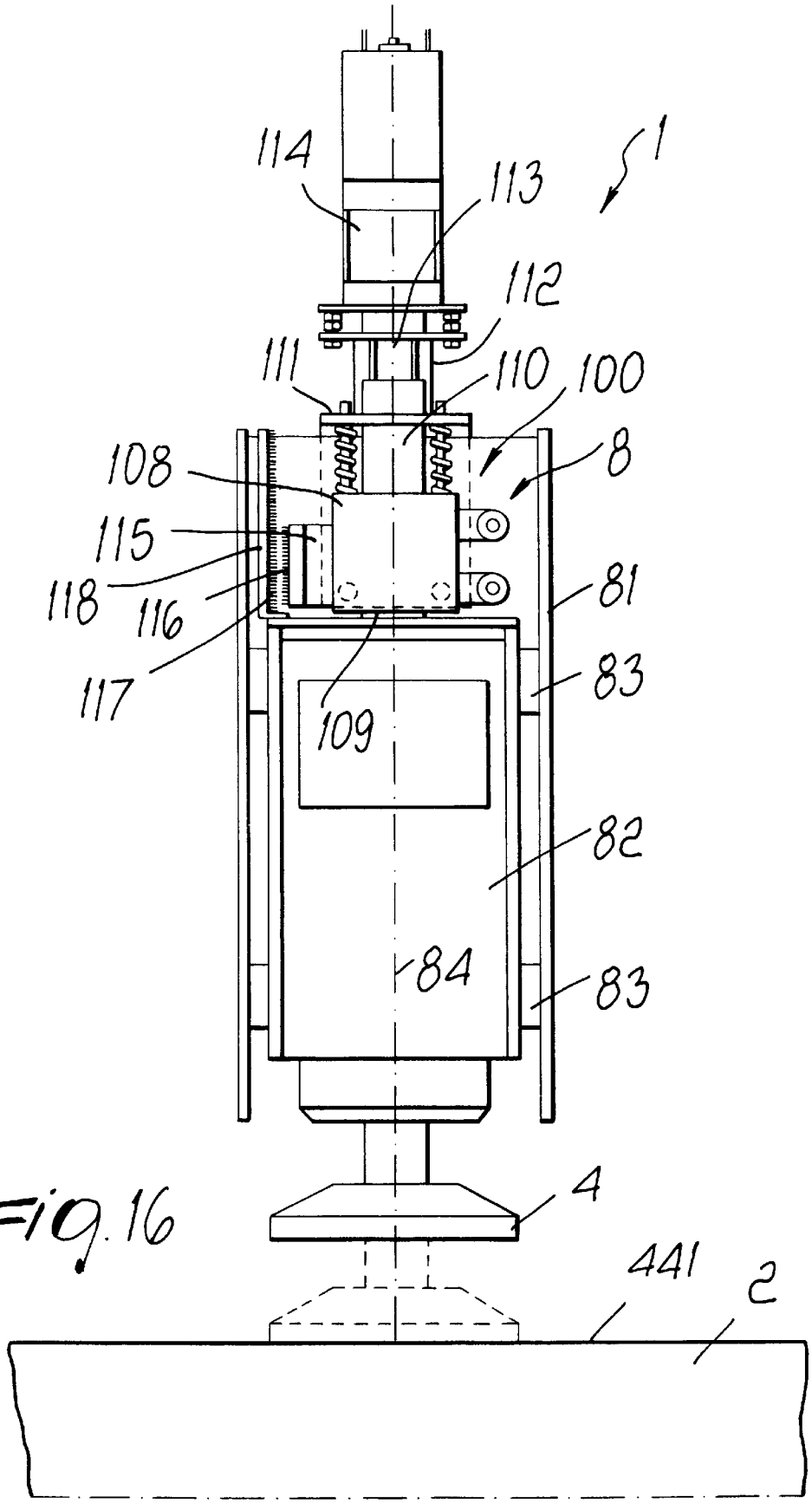
FIG. 16 is a front view of an operating unit of the apparatus according to the invention.
Figure 19:
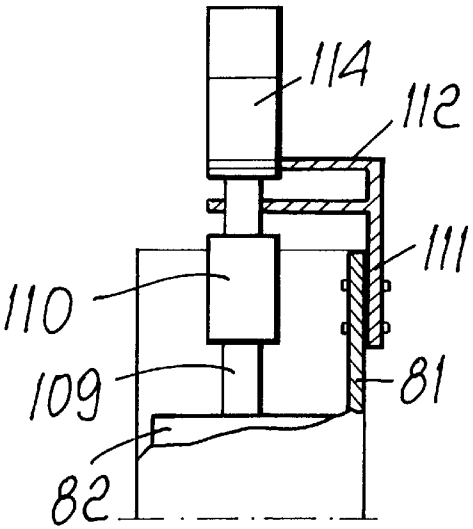
FIG. 19 is a partial sectioned view of the top side view of the operating unit shown in FIG. 18.
Figure 18:
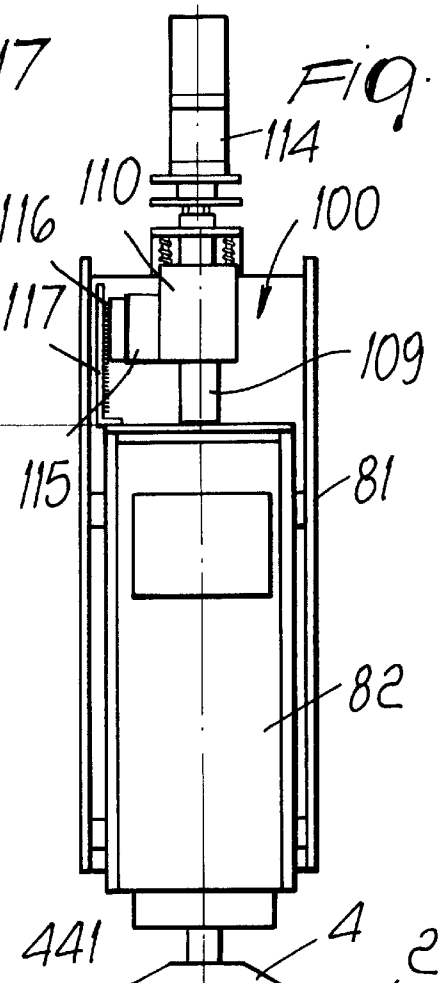
FIGS. 17 and 18 show the operating unit of FIG. 16 during two different steps of the work.
Figure 17:
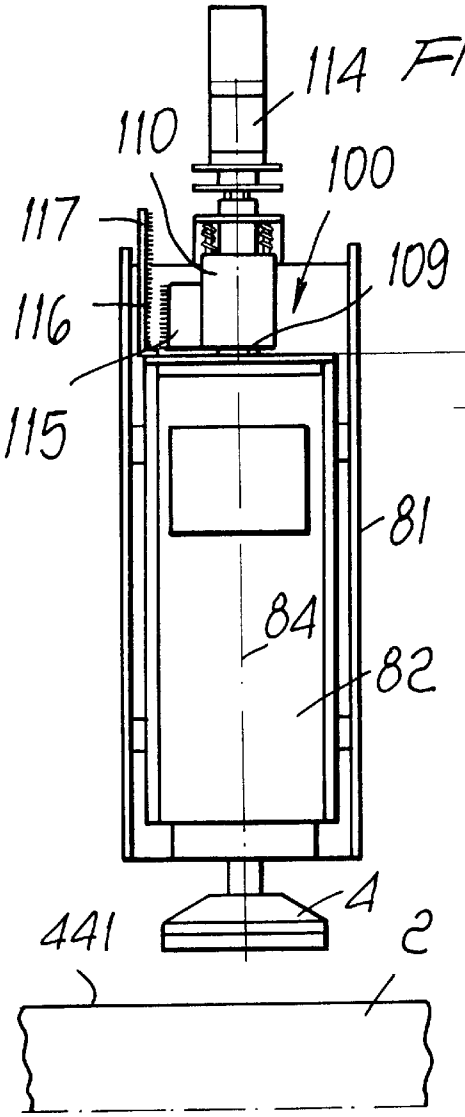

Each operating head 1 is associated with the chain 53 by means of a support 81 and is provided with wheels 91 sliding on tracks 92 provided in the central structure 50 and which have the function of supporting each operating head and of driving it when the chain 53 is driven. As better shown in FIGS. 16, 17 and 18, each support 81 is provided with a guide means 83 which have a motor 82 and allow the motor 82 to vertically shift along the axis 84 of the support 81 when the motor 82 is made to move vertically up and down by an oscillation assembly, globally designated by the reference numeral 8, and is supported by the same support 81. In order to move the smoothing assembly 5 against said roller 2, the frame 51 is vertically and horizontally moved by a sliding means which connects it to each vertical rod 35 and which comprises a vertical sliding means and a transversal sliding means, as shown in FIGS. 7 to 10.

Figure 7:
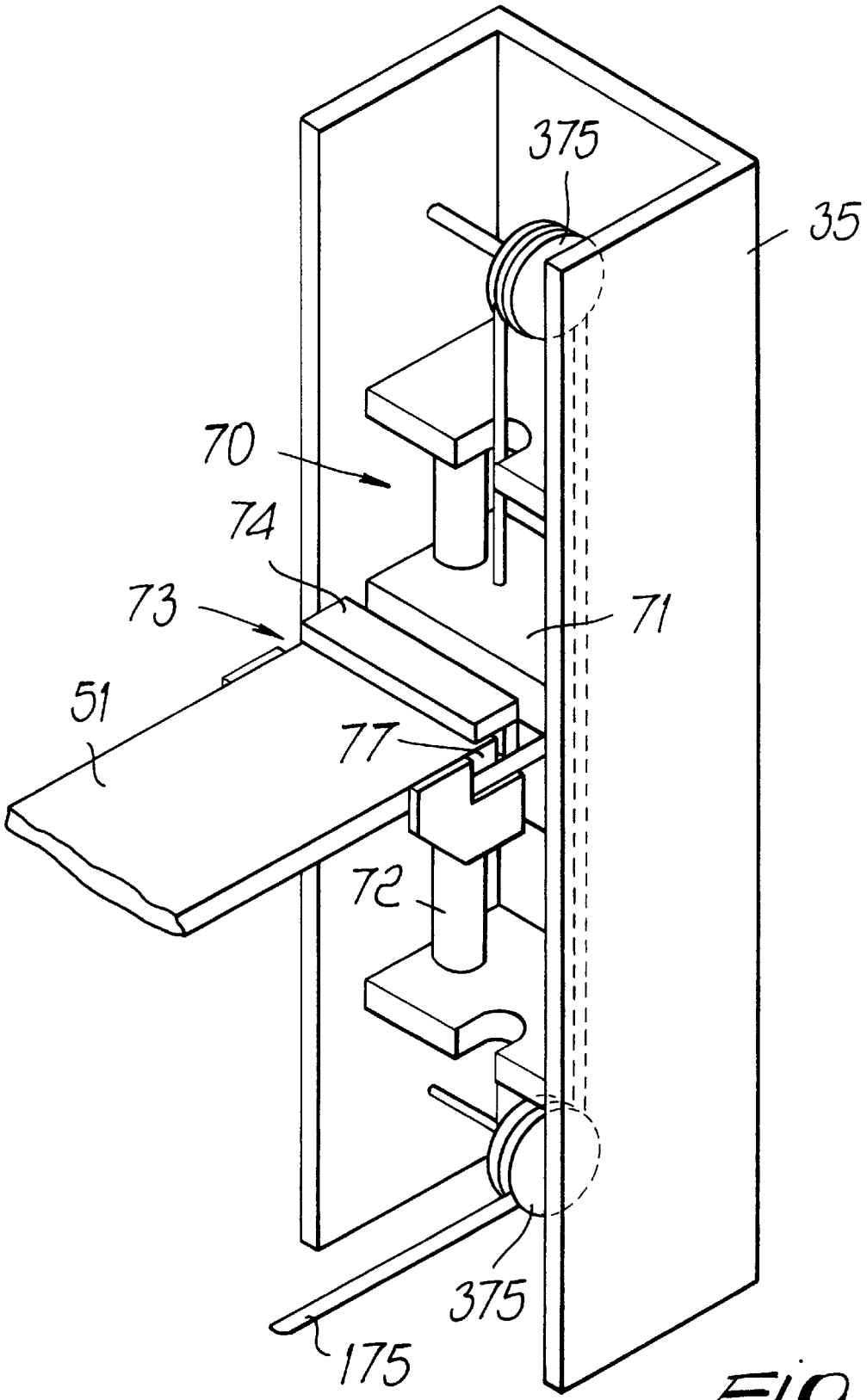
FIG. 7 is an isometric detailed view of one vertical rod which connects the frame to the baseframe of the apparatus according to the invention.
Figure 8:
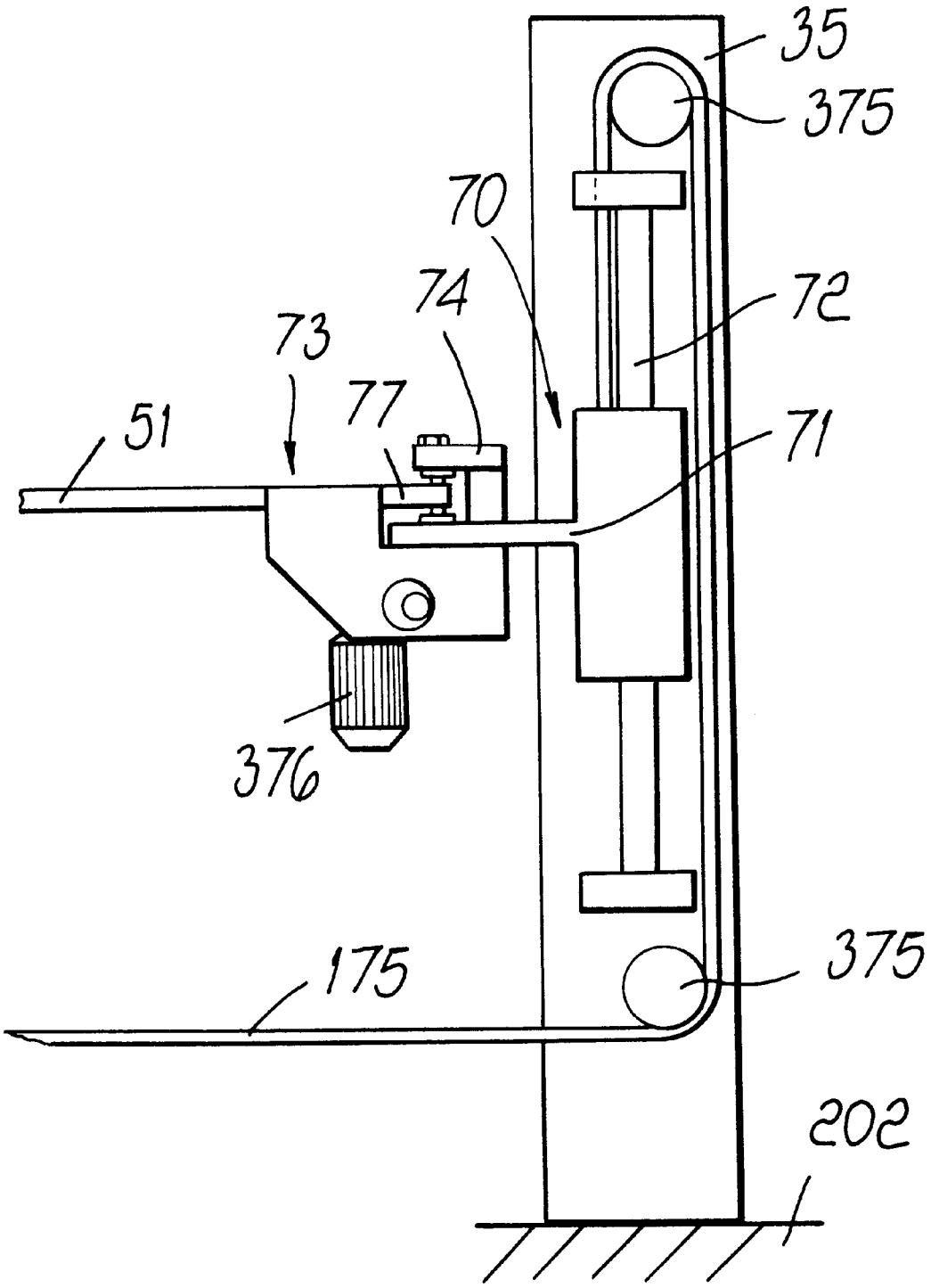
FIG. 8 is a front view of the vertical rod of FIG. 7.
Figure 9:
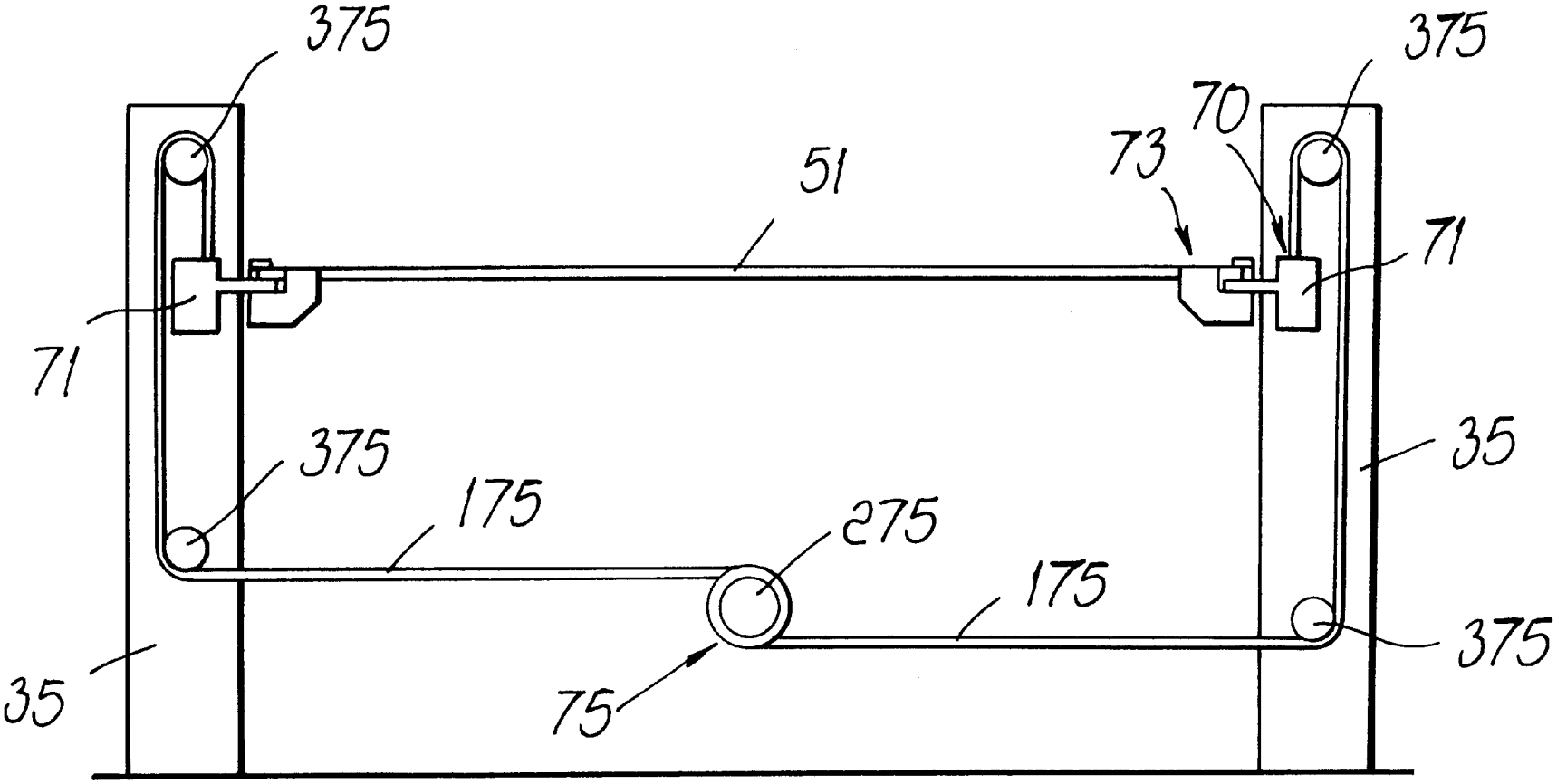
FIG. 9 shows the vertical moving system of the frame which supports the operating heads, the last ones not represented for simplicity.

The vertical sliding means, globally designated by the reference numeral 70 and shown in FIGS. 7, 8 and 9, comprises a plate 71, vertically sliding along the columns 72 fixed to said vertical rod 35 and supported by the baseframe 202, which allows the raising and the lowering of the frame 51.

Figure 10:
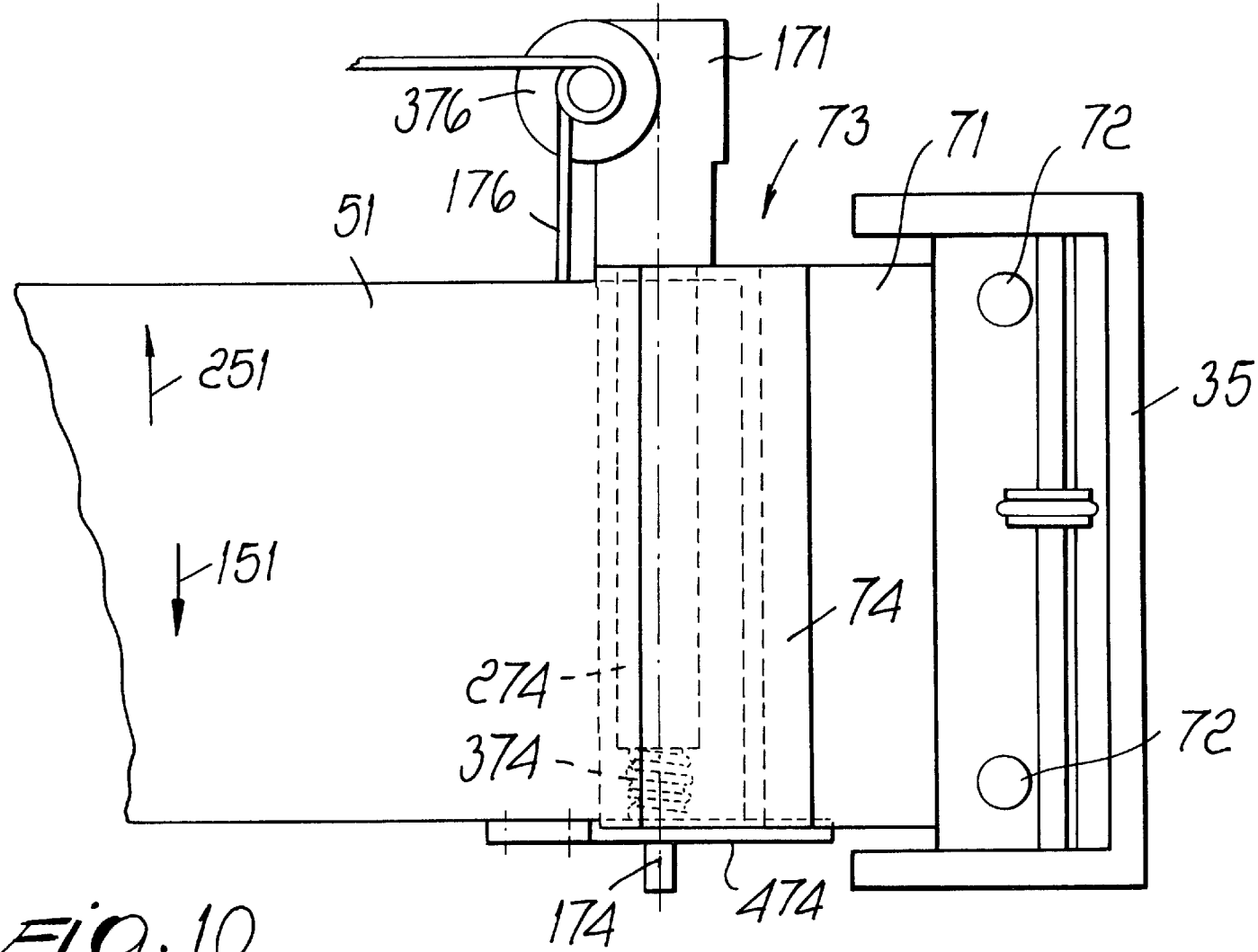
FIG. 10 is a detailed view of the sliding means of the frame against the vertical rod shown in FIG. 7-1.

The transversal sliding means, globally designated by the reference numeral 73 and shown in FIGS. 8, 9 and 10, moves in a transversal direction against the longitudinal axis 45 of the roller 2, and comprises a slider 74 fixed to the plate 71 which allows the horizontal moving of the end 77 of the frame 51 against the plate 71.

Figure 11:
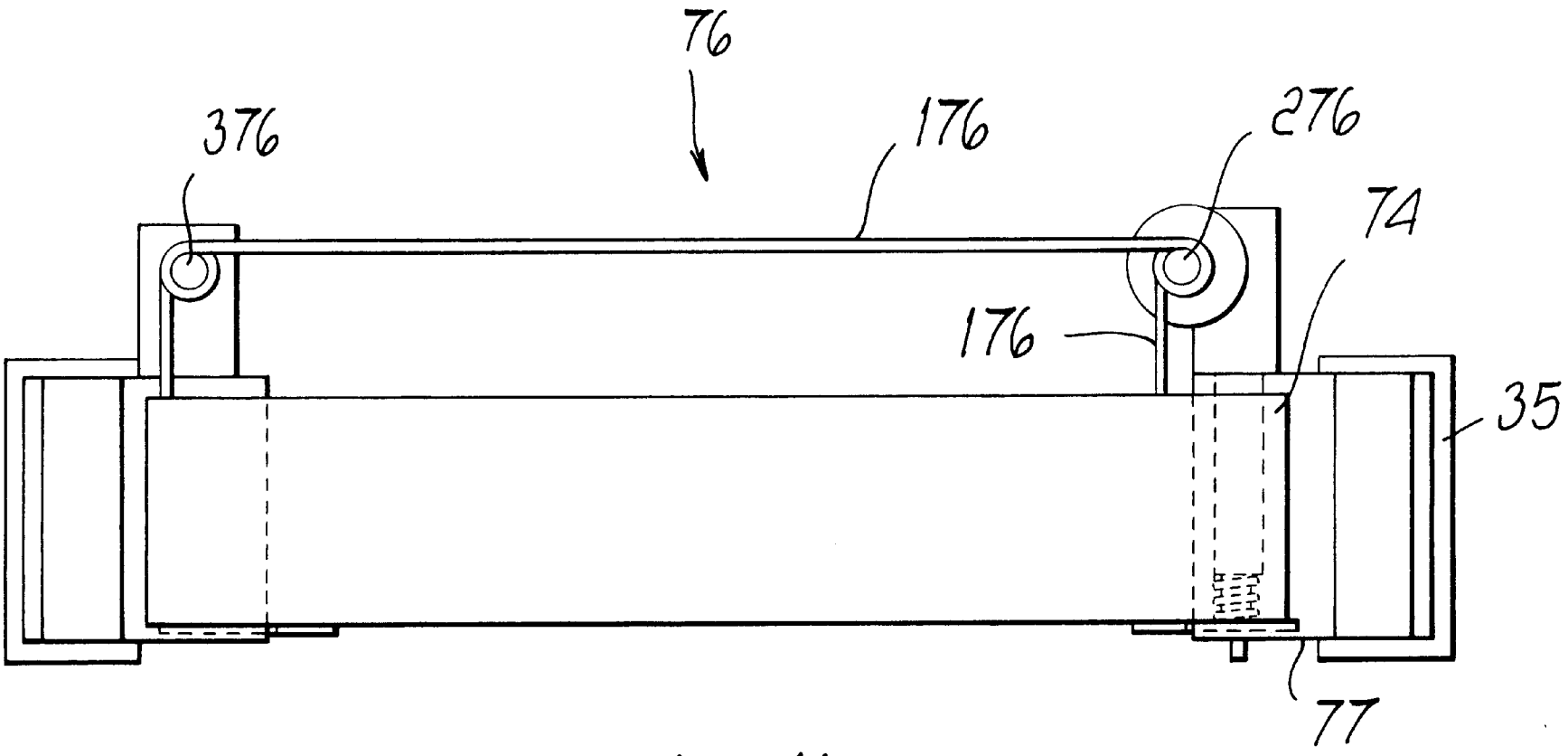
FIG. 11 shows the horizontal moving system of the frame which supports the operating heads, the last ones not drawn.

A drive means 75, 76 is provided to move the frame 51 vertically and transversally. The drive means comprises a vertical handling means, globally designated by the reference numeral 75 and shown in FIG. 9, comprising cables 175, supported by pulleys 375, each cable having an end connected to one of the plates 71 and the opposite end wound on a motorized drum 275 . The drive means also comprises a transversal handling means, globally designated by the reference numeral 76 and shown in FIG. 11 in transversal direction against the axis of the cylinder 2, which comprise cables 176 supported by pulleys 376, each cable having an end connected to one end 77 of frame 51 and the opposite end connected to a roll-up drum 276 which is made turn by an engine 376.

As shown in FIG. 10, engine 376 is associated with plate 71 by means of a bracket 171 and is therefore fixed to the frame 51. Bracket 171 supports a shaft 174 passing inside a tubular element 274 with the interposition of a spring 374 coaxial to the shaft 174. The shaft 174 and the tubular element 274 are transversally located on the frame 51. A plate 474, fixed to the frame, is located on the opposite side of the engine 376 and is biased by the spring 374. When the pull of cable 176 moves the frame 51 in the direction indicated by an arrow 251 in FIG. 10, the plate 474 presses the spring 374 and its elastic recovery allows the frame 51 to return according to the direction, indicated by an arrow 151, opposite to the direction 251, when cable 176 is released.

In order to begin working, the cylindrical body 2 has to be smoothed first between the tailstocks 40 in a way that the surface 441 to be smoothed is horizontal and parallel to the abrasive surface of each rotating disk 4.

The operating heads 1 are then brought near to the surface 441 to be smoothed, moving the frame 51 by sliding means and by handling means and feeding with compressed air the pneumatic cylinder 100 with which the oscillation assembly 8 belonging to each operating unit is equipped.

Figure 13:
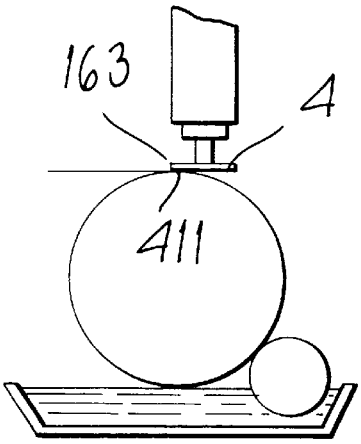
FIGS. 12, 13, 14 and 15 show different steps of the work of the machine according to the invention.
Figure 12:
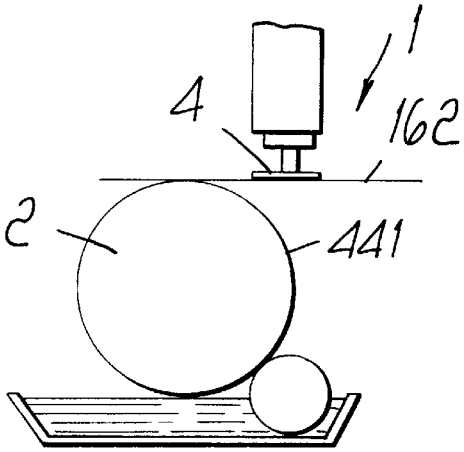
Figure 14:
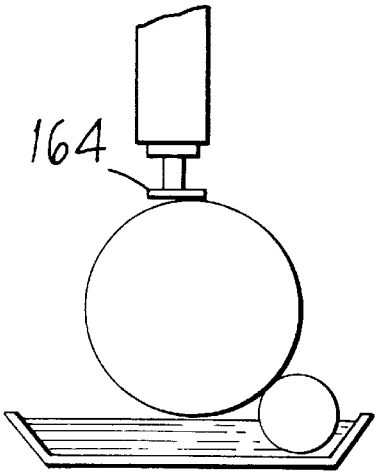

The rotating disks 4 are then aligned on a level 162 tangent to the surface 441 to be smoothed, as it can be observed in FIG. 12, and then in contact with the surface to be worked as shown in FIGS. 13 and 14.

The engine 82 of each operating head 6 is switched on, so that the rotating disk 4 of each head starts the operation while at the same time, motor means, not shown in the drawings, rotates the sprocket wheel 52 which moves the chain 53 and therefore all the operating heads 1 according the longitudinal direction, parallel to the axis 45 of the cylinder 2. This cylinder is made turn around its own axis 45 by the motor 42 and it is worked on its whole length and on its whole lateral surface.

Figure 15:
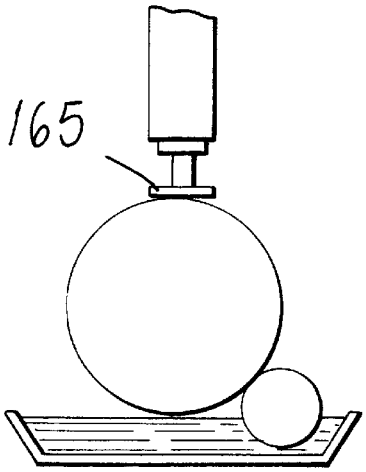

During the working, acting on the handling transversal means 76, the frame 51 and so the smoothing assembly 5 and the operating heads 1 are horizontally shifted in such a way that, as shown in FIGS. 14 and 15, additional points 163, 164, and successively all the points of the abrasive surface of the rotating disk 4, enter progressively into contact with the generatrix of the surface 441 of the cylinder 2 to be smoothed. This allows a uniform use of the abrasive surface of the rotating disk and prevents kneading.

All the rotating disks 4 should work the surface 441 of the cylinder 2 being placed in contact with it in correspondence of an intermediate point of their internal surface that, as visible in FIGS. 13, 14, and 15, corresponds respectively to the points 163, 164, and 165 as the heads are transversally moved against the cylinder, so to successively affect all the abrasive working area of the disk.

The action of the first rotating disk 4, and if necessary also of the second rotating disk, is very important to the optimization of the working of the apparatus. The first, and possibly the second, rotating disks contact the surface to be worked and, operating as it has been already described, break and eliminate the chromium coating not by abrasion, as in the prior art machines but rather by crumbling the coating into pieces 230 without abrasion.

The successive rotating disks are provided with abrasive means which have an abrasive finishing action.

During the working, each rotating disk 4 is moved also vertically in an alternate way, up and down against the working surface 441 by the oscillation assembly 8, equipped to each operating unit 1.

The presence of such oscillation assembly has an important function in the smoothing action of the cylinder and provides a cylindrical surface substantially free from dents as it maintains a constant pressure of the rotating disks 4 against the surface 441.

Each oscillation assembly 8 comprises a pneumatic cylinder 100 having a stem 109 fixed to the engine 82 and a body 108 fixed by the bracket 111 to the structure 81 which is in turn fixed to the chains 53 and which support the engine 82.

Figure 4:
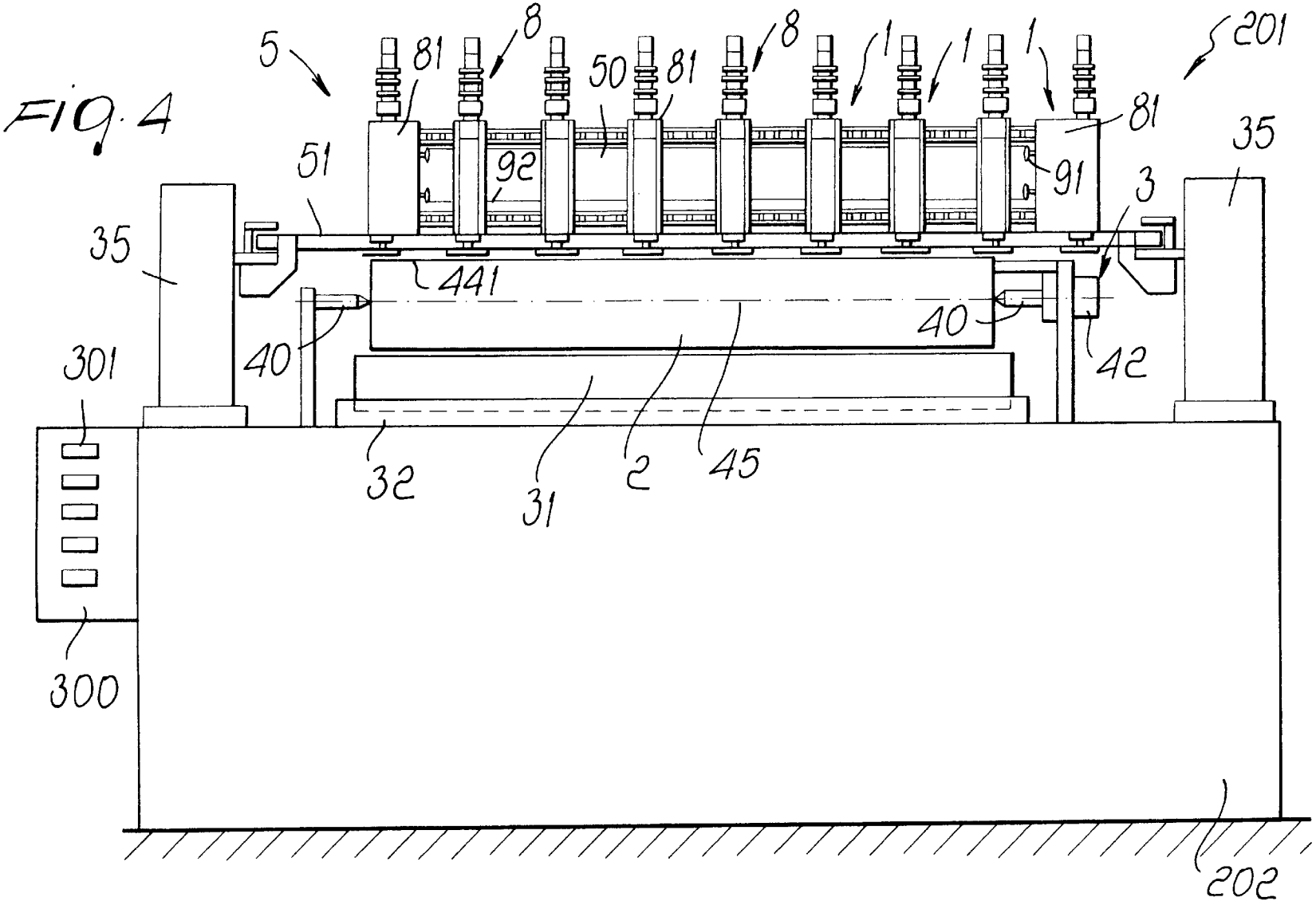
FIG. 4 is a front view of the apparatus according to the invention.
Figure 5:
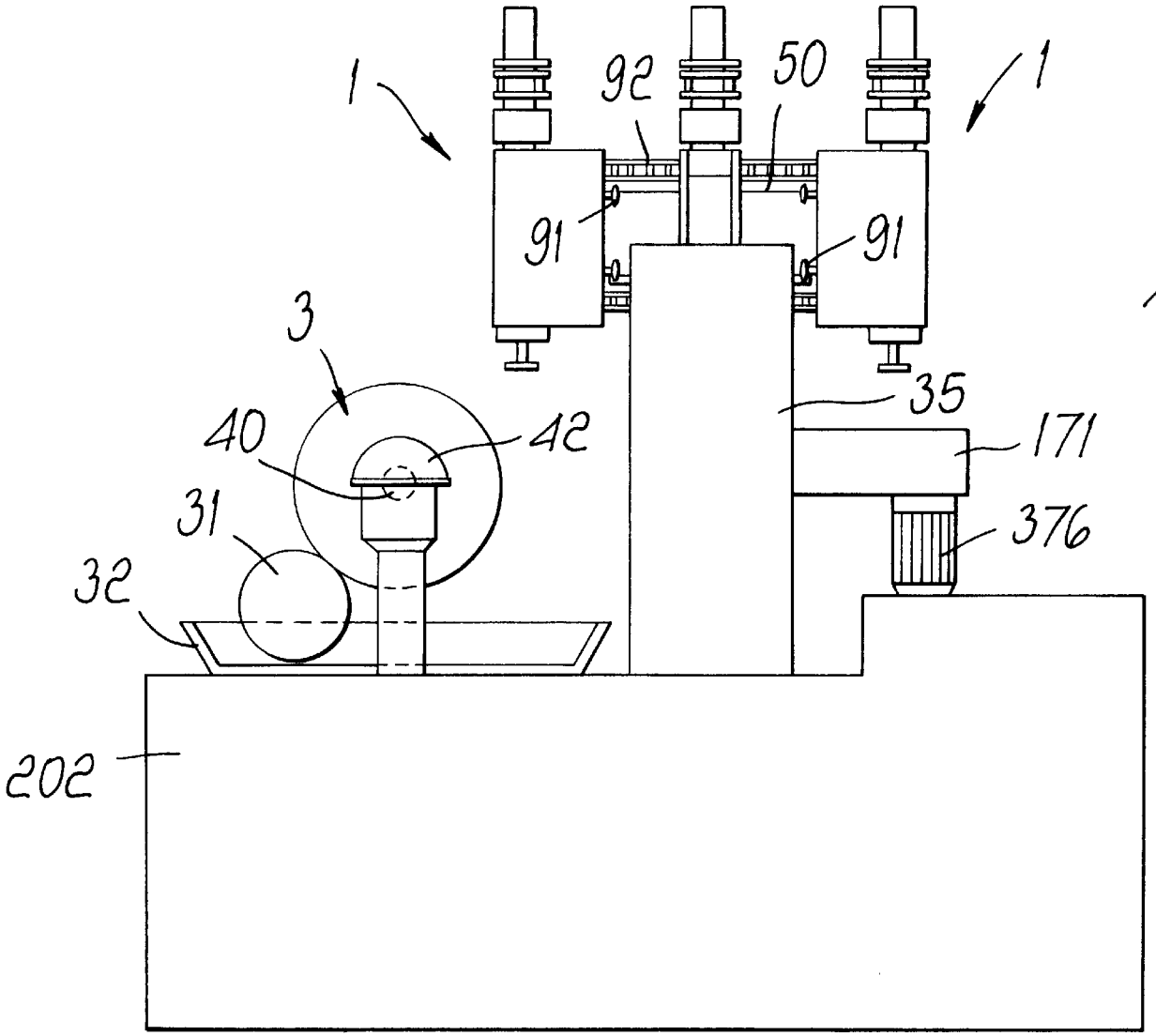
FIG. 5 is a side view of the apparatus of FIGS. 1–4.
Figure 6:
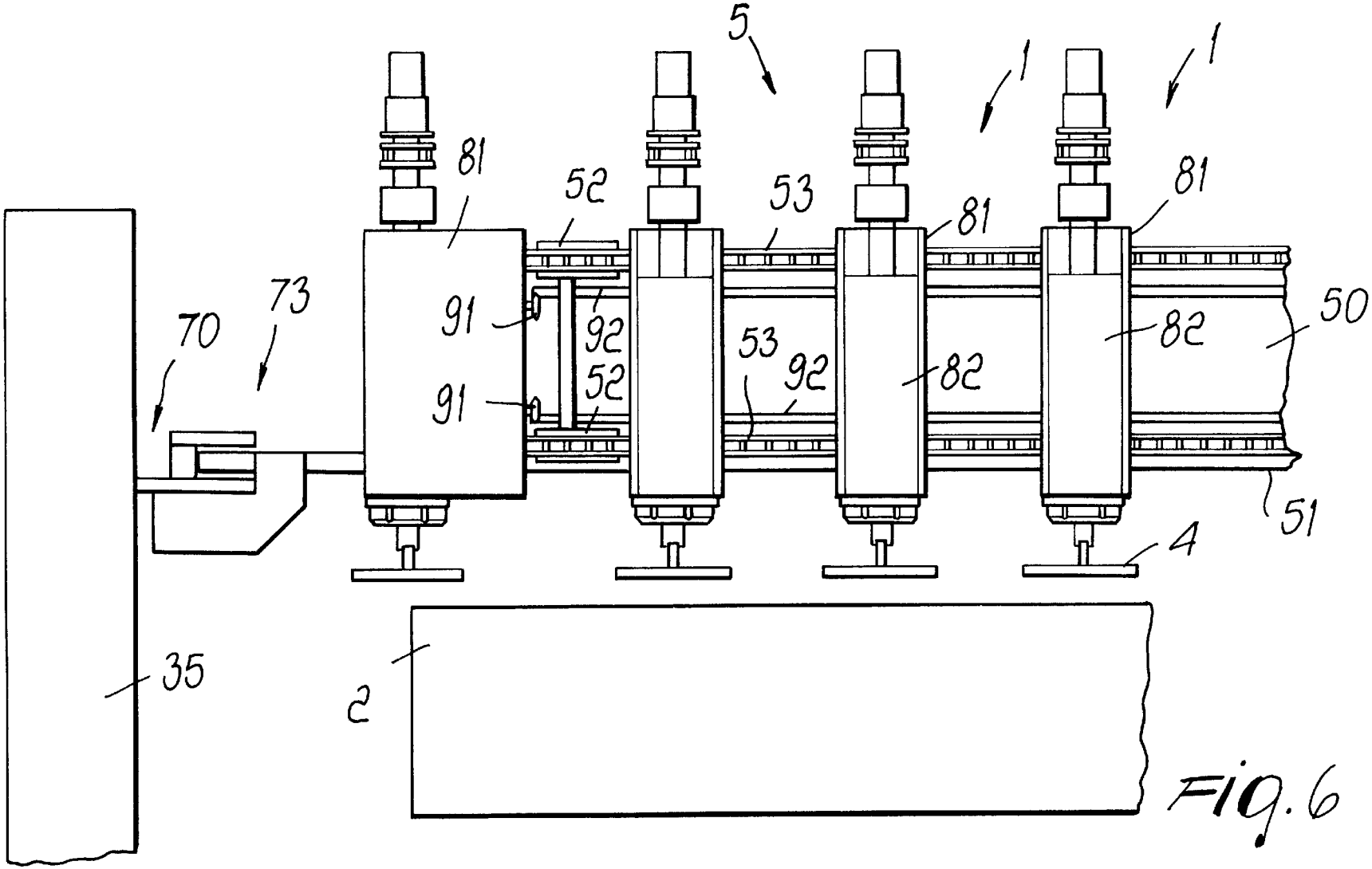
FIG. 6 shows a front view of the smoothing assembly, in detail, equipped to the apparatus according to the invention.

When the rotating disk 4 finds a point with stronger resistance, the engine 82 absorbs more current because of the greater hardness of the cylinder to be smoothed in that point that require higher abrasive power from the abrasive surface 41 of the disk 4. This higher absorption of current is read by an ammeter circuit which is part of a control unit 300, visible in FIG. 4, and the related absorption of the current is indicated on a display 301.

In particular, on unit 300 a plurality of digital displays are available, each one connected by an ammeter circuit to the engine 82 with which a specific operating unit 1 is equipped.

When the engine 82 requires more current, it is necessary to raise the rotating disk 4 and this is obtained by the oscillation assembly 8. In fact the pneumatic cylinder 100 has the body 108 provided with a female thread 110 with which a screw 113 is coupled belonging to an engine 114 fixed by a square 112 to the same bracket 111.

The body 108 of the pneumatic cylinder 100 is associated with the engine 82 by a pneumatic auxiliary cylinder 115 which is provided with a first connecting element 116 which contrasts a second connecting element 117 fixed to a plate 118 which is fixed to the engine itself 82.

The connecting means 116 and 117 are formed by a plurality of metallic points fixed to a support adapted to provide mutual friction when they are coupled, in such a way to avoid relative sliding among the members of the system.

When the auxiliary cylinder 115 make connecting means 116 and 117 to mutually adhere, the body 108 of the pneumatic cylinder 100 forms a single body with the engine 82 and so any possibility of relative motion between the two, due to the pneumatic action that is to say to the moving of the stem 109, is prevented. On the contrary, a signal sent by the ammeter circuit as it detects an increase or a decrease of the current absorbed by the engine 82, puts in rotation according the counterclockwise or the clockwise direction the engine 114 which accordingly rotated the screw 113 that, as it engages the female screw 110, causes the body 108 to raise or lower the pneumatic cylinder 100 and thus also the engine 82 and of the relative rotating disk 4. In this manner, the system reacts to each pressure variation found by the abrasive disk 4 during the working and which corresponds to a current absorbing variation. The system reacts with a signal sent by the control ammeter circuit to the engine 114, activating it and raising or lowering, according to the situations, the whole engine 82 and changing in this way the contact between each disk 4 and the surface 441 of the cylinder 2 under working.

During the horizontal motion and the contemporary rotation of the disks 4, also a vertical oscillatory movement is performed, according to the variations of the absorbed current caused by the different hardness that each abrasive disk finds during the working.

It has been seen in practice that the apparatus and the method according to the invention achieve the intended aims and objects.

In particular, the method according to the invention allows to remove the protective chromium covering by a breaking action rather than an abrasive action. Removing the chromium coating and the pattern and polishing the copper layer are effected with the same machine thus reducing the working time. The method according to the present invention is faster and cheaper than the methods of the prior art.

The apparatus according to the present invention provides a surface which is effectively cylindrical, polished and free from waving, because of the presence in each operating unit of the oscillation assembly that during the longitudinal motion of the rotating abrasive disks allows the raising and the lowering of the disks against the surface to be smoothed, by an ammeter control and as a function of the current variations due to the variations of the resistance that each abrasive disk finds during the working. It is clear that to obtain the best results related to the hardness of the surface to be removed, abrasive disks with different grains and the most useful rotating speed of the same disks, will be used.

Furthermore, the ammeter circuits, which drive the current absorption in a differentiated way for each operating unit, allow to change the smoothing pressure for each one.

As the rotating disks of the operating heads work parallel to the generatrix of the cylinder to be worked, it is possible to eliminate all the helicoidal marks produced by previous turning or grinding operations.

The number of operating heads fitted to the machine according to the invention can be any and each head forms a smoothing "module".

In order to effectively break the chromium plating, the pressure of the disk on the surface of the roller has to be adjusted to a set value and this value has to be maintained during the entire operation. However, several factors may cause the disk to modify its distance from the roller surface and therefore to modify the pressure value. In the apparatus according to the present invention, the pressure is maintained constant and at the desired value. The desired pressure value is initially set on the control unit of the apparatus depending on the type of roller to be worked. Then the apparatus is activated and initially the pneumatic system brings the disk in contact with the roller surface. In this phase approaching the pressure control is not active, while as soon as the disk comes into contact with the surface the pneumatic system is deactivated, by means of an accessory pneumatic system.

The apparatus according to the invention may be modified without departing the scope of the appended claims. For example, the sliding devices and the moving means of the frame and the operating units supported by the frame may be constructed differently, as well as the oscillation assembly with which each operating unit is provided.

Although the invention has been described with reference to particular means, material, and embodiments, it is to be understood that the invention is not limited to the particulars disclosed and extends to all equivalents within the scope of the claims.

The present application is based upon Italian patent application No. VI97A000036, filed on Feb. 28, 1997, the disclosure of which is hereby expressly incorporated by reference thereto, and the priority of which is hereby claimed under 35 U.S.C. § 119.

What is claimed is:

1. A method for polishing a roller, particularly a gravure roller, and for removing the chromium plating thereof, wherein said roller has a metallic shell galvanically covered by a copper layer having a pattern and a protective chromium plating, the method comprising the following steps:

turning the roller around a central longitudinal axis;

tapping said chromium plating by means of blunt bodies associated with a first rotating disk, thereby removing said chromium plating; said chromium plating being broken and removed through the elastic collapsing of said underlying copper layer when said blunt bodies tap said chromium plating;

smoothing said copper layer by means of a second rotating disk provided with abrasive members.

2. The method according to claim 1, wherein said tapping and smoothing steps are continuously controlled by measuring the current absorbed by said rotating disks while operating on said roller.

3. An apparatus for polishing a roller, particularly a gravure roller, and for removing the chromium plating thereof, comprising a baseframe support means secured to the baseframe for supporting said roller along a central axis;

a drive for rotating said roller about said axis;

a plurality of polishing heads, each including a rotatable disk for engaging the surface of said roller;

a frame supporting said polishing heads secured to said baseframe;

first means secured to the baseframe for moving the heads in a vertical direction with respect to the central axis of the roller; and second means secured to the frame for moving the heads in a transverse direction to the central axis of the roller, said first and second means being continuously adjustable in both transverse and vertical directions by means of electromechanical control means adapted to measure the current absorbed by said disk working on said roller.

* * * * *